US010492016B2

(12) United States Patent
Lee et al.

(10) Patent No.: US 10,492,016 B2
(45) Date of Patent: Nov. 26, 2019

(54) METHOD FOR OUTPUTTING AUDIO SIGNAL USING USER POSITION INFORMATION IN AUDIO DECODER AND APPARATUS FOR OUTPUTTING AUDIO SIGNAL USING SAME

(71) Applicant: LG ELECTRONICS INC., Seoul (KR)

(72) Inventors: Tungchin Lee, Seoul (KR); Jongyeul Suh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/718,866

(22) Filed: Sep. 28, 2017

(65) Prior Publication Data

US 2018/0091918 A1 Mar. 29, 2018

Related U.S. Application Data

(60) Provisional application No. 62/401,178, filed on Sep. 29, 2016.

(51) Int. Cl.
*H04R 5/00* (2006.01)
*H04S 7/00* (2006.01)
(Continued)

(52) U.S. Cl.
CPC ..... *H04S 7/303* (2013.01); *G10L 19/008* (2013.01); *H04S 1/007* (2013.01); *H04S 2400/01* (2013.01);
(Continued)

(58) Field of Classification Search
USPC ..... 381/22, 23, 20, 21, 10, 61, 77, 80, 82, 381/120, 104, 106, 107, 108, 109, 102,
(Continued)

(56) References Cited

U.S. PATENT DOCUMENTS

2009/0116652 A1* 5/2009 Kirkeby ..... H04S 7/303 381/1
2016/0198281 A1* 7/2016 Oh ..... H04S 3/00 381/310
(Continued)

FOREIGN PATENT DOCUMENTS

WO WO-2015066062 A1 * 5/2015 ..... H04S 7/304
WO WO-2015180866 A1 * 12/2015 ..... G10L 19/00

*Primary Examiner* — Leshui Zhang
(74) *Attorney, Agent, or Firm* — Birch, Stewart, Kolasch & Birch, LLP

(57) ABSTRACT

A method and apparatus for outputting an audio signal corresponding to a user position are disclosed. The method includes receiving an audio signal and providing a decoding audio signal and decoded metadata, checking whether a user position is changed in an arbitrary space using user position information including a user position change indicator and user position change offset, when the user position is changed, providing modified metadata obtained by correcting the decoded metadata based on the user position change offset, and rendering the decoded audio signal using the modified metadata. Accordingly, it is possible to provide an audio sound image that is changed in response to change in user position in an arbitrary space, thereby providing more realistic audio output.

17 Claims, 8 Drawing Sheets

(51) Int. Cl.
*H04S 1/00* (2006.01)
*G10L 19/008* (2013.01)

(52) U.S. Cl.
CPC ..... *H04S 2400/11* (2013.01); *H04S 2400/13* (2013.01); *H04S 2420/11* (2013.01)

(58) Field of Classification Search
USPC ..... 381/103; 700/94; 704/501, 504, 704/E19.042, E19.044, E19.048
See application file for complete search history.

(56) References Cited

U.S. PATENT DOCUMENTS

| | | | | |
|---|---|---|---|---|
| 2016/0266865 | A1* | 9/2016 | Tsingos ..... | H04S 7/304 |
| 2017/0013388 | A1* | 1/2017 | Fueg ..... | H04S 7/301 |
| 2017/0223429 | A1* | 8/2017 | Schreiner ..... | G10L 19/00 |

* cited by examiner

FIG. 5A

| | Syntax | No. of bits | Mnemonics | |
|---|---|---|---|---|
| | ei_GroupInteractivityStatus(ei_numGroups) | | | |
| | { | | | |
| 801 | is UserPosChange; | 1 | bslbf | 800 |
| | if( isUserPosChange ==1 ) { | | | |
| 802 | up_azOffset; | 8 | uimsbf | |
| 803 | up_distOffset; | 4 | uimsbf | |
| | } | | | |
| | for(grp = 0; grp< numGroups; grp++ ) { | | | |
| 901 | ei_groupID[grp]; | 7 | uimsbf | 900 |
| 902 | ei_onOff[grp]; | 1 | bslbf | |
| 903 | ei_route ToWIRE[grp]; | 1 | bslbf | |
| | if( ei_routeToWIRE[grp]==1 ) { | | | |
| 904 | route ToWireID[grp]; | 16 | uimsbf | |
| | } | | | |
| | if( ei_onOff[grp] == 1 ) { | | | |
| 905 | ei_changePosition[grp]; | 1 | bslbf | |
| | if( ei_changePosition[grp] ) { | | | |
| 906 | ei_azOffset[grp]; | 8 | uimsbf | |
| 907 | ei_elOffset[grp]; | 6 | uimsbf | |
| 908 | ei_distFact[grp]; | 4 | uimsbf | |
| | } | | | |
| 909 | ei_changeGain; | 1 | bslbf | |
| | if( ei_changeGain ) { | | | |
| 910 | ei_gain; | 7 | uimsbf | |
| | } | | | |
| | } | | | |
| | } | | | |
| | } | | | |

FIG. 5B

| Syntax | No. of bits | Mnemonics |
|---|---|---|
| ei_GroupInteractivityStatus(ei_numGroups) | | |
| { | | |
| is UserPosChange; | 1 | bslbf |
| if( isUserPosChange ==1 ) { | | |
| up_azOffset; | 8 | uimsbf |
| up_elOffset; | 6 | uimsbf |
| up_distOffset; | 4 | uimsbf |
| } | | |
| for(grp = 0; grp< numGroups; grp++ ) { | | |
| ei_groupID[grp]; | 7 | uimsbf |
| ei_onOff[grp]; | 1 | bslbf |
| ei_route ToWIRE[grp]; | 1 | bslbf |
| if( ei_routeToWIRE[grp]==1 ) { | | |
| route ToWireID[grp]; | 16 | uimsbf |
| } | | |
| if( ei_onOff[grp] == 1 ) { | | |
| ei_changePosition[grp]; | 1 | bslbf |
| if( ei_changePosition[grp] ) { | | |
| ei_azOffset[grp]; | 8 | uimsbf |
| ei_elOffset[grp]; | 6 | uimsbf |
| ei_distFact[grp]; | 4 | uimsbf |
| } | | |
| ei_changeGain; | 1 | bslbf |
| if( ei_changeGain ) { | | |
| ei_gain; | 7 | uimsbf |
| } | | |
| } | | |
| } | | |
| } | | |

800

804

METHOD FOR OUTPUTTING AUDIO SIGNAL USING USER POSITION INFORMATION IN AUDIO DECODER AND APPARATUS FOR OUTPUTTING AUDIO SIGNAL USING SAME

This application claims the benefit of U.S. provisional applications 62/401,178 field on Sep. 29, 2016, which is hereby incorporated by reference as if fully set forth herein.

BACKGROUND OF THE INVENTION

Field of the Invention

The present invention relates to a method for outputting an audio signal corresponding to a user position using user position information and an apparatus for outputting an audio signal using the same.

Discussion of the Related Art

Recently, along with development of information technology (IT), various smart devices have been developed. In particular, such a smart device basically provides an audio output function with various effects. In particular, various methods for more realistic audio output in a virtual reality environment or a three-dimensional (3D) audio environment have been attempted. In this regard, MPEG-H has been developed as a new international standard for audio coding. MPEG-H is a new internal standardization project for realistic immersive multimedia services using an ultra high-definition large-screen display (e.g., 100 inches or more) and a super-multi channel audio system (e.g., 10.2 channel or 22.2 channel). In particular, in the MPEG-H standardization project, a sub group termed by "3D Audio Adhoc Group (AhG)" is established and is working in order to implement a super-multi channel audio system.

An object of MPEG-H 3D audio is to remarkably enhance an existing 5.1/7.1 channel surround system to provide highly realistic 3D audio output. To this end, various types of audio signals (channel, object, and HOA) are received and reconfigured for a given environment. In addition, it is possible to adjust an object position and volume via interaction with a user and selection of preset information.

An MPEG-H 3D audio decoder provides a binaural renderer function. Accordingly, when an audio signal decoded from a bitstream is reproduced by headphones or earphones installed in a head tracker, a user can feel as if there are in an arbitrary space by virtue of binaural room impulse response (BRIR) of a binaural renderer. In addition, the user can feel as if a sound image is positioned at the same position irrespective of a change in user head direction.

However, these effects are effective only at a fixed location. That is, there is a problem in that an existing audio coding method cannot handle a change in user position. When a user position is changed, sense of reality is definitely degraded. Accordingly, there is a limit in using the existing audio coding method in an environment in which a user freely moves in an arbitrary space. Accordingly, when a user position is changed, a position of an audio object is not changed therewith, which causes an impediment to sense of immersion.

The present invention proposes a method for enhancing audio output performance by adding changed user position information to user interaction data in order to determine a user position during audio decoding.

SUMMARY OF THE INVENTION

An object of the present invention is to provide an audio output method using user position information in an arbitrary space.

Another object of the present invention is to provide an environment in which a user position is capable of being freely changed in an arbitrary space for an MPEG-H 3D audio decoder.

Another object of the present invention is to provide an audio output apparatus for providing audio output using changed user position information.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method for outputting an audio signal corresponding to a user position includes receiving an audio signal and providing a decoded audio signal and a decoded metadata, checking whether a user position is changed in an arbitrary space using user position information including a user position change indicator and user position change offset, when the user position is changed, providing modified metadata obtained by correcting the decoded metadata based on the user position change offset, and rendering the decoded audio signal using the modified metadata.

The user position information may be provided from externally input user interaction information.

The user position change offset may include azimuth offset and distance offset of at least a user in the arbitrary space.

The user position change offset may include azimuth offset, elevation offset, and distance offset of at least a user in the arbitrary space.

The user position change offset may include any one of azimuth offset and elevation offset of at least a user in the arbitrary space.

The modified metadata may include a changed relative position and/or gain of an audio object in the arbitrary space, corresponding to change in user position.

The method may further include performing binaural rendering using binaural room impulse response (BRIR) for 2-channel surround audio output of the rendered audio signal.

In another aspect of the present invention, an audio output apparatus corresponding to a user position includes an audio decoder configured to receive an audio signal and to provide a decoded audio signal and decoded metadata, a metadata processor configured to check whether a user position is changed in an arbitrary space using user position information including a user position change indicator and user position change offset and to, when the user position is changed, provide modified metadata obtained by correcting the decoded metadata based on the user position change offset, and a renderer configured to render the decoded audio signal using the modified metadata.

The audio output apparatus may further include a binaural renderer configured to perform binaural rendering for 2-channel 3D surround audio output of the rendered audio signal.

In another aspect of the present invention, an audio output apparatus corresponding to a user position includes a unified speech and audio coding (USAC)-3D audio decoder configured to receive an audio signal and to provide a decoded audio signal and decoded metadata appropriate for characteristics of the received audio signal, a metadata processor configured to check whether a user position is changed in an arbitrary space using user position information including a user position change indicator and user position change offset and to, when the user position is changed, provide modified metadata obtained by correcting the decoded metadata based on the user position change offset, and a transformer configured to render or convert the decoded audio signal using the modified metadata according to characteristics of the received audio signal.

The transformer may operate as a format converter when the characteristics of the received audio signal corresponds to a channel signal, operate as an object renderer in the case of an object signal, operate as a spatial audio object coding (SAOC) 3D-decoder in the case of a SAOC transport channel, and operate as a higher order ambisonics (HOA) renderer in the case of a HOA signal.

The user position information may be provided in an externally input user interaction syntax.

The user position change offset may include any one of azimuth offset and elevation offset of at least a user in the arbitrary space.

The modified metadata may include a changed relative position and/or gain of an audio object in the arbitrary space, corresponding to change in user position.

The audio output apparatus may further include a binaural renderer configured to perform binaural rendering for 2-channel 3D surround audio output of an audio signal transformed by the transformer.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIGS. 5A and 5B show an example of audio syntax for providing user position information according to the present invention.

DETAILED DESCRIPTION OF THE INVENTION

Figure 1:
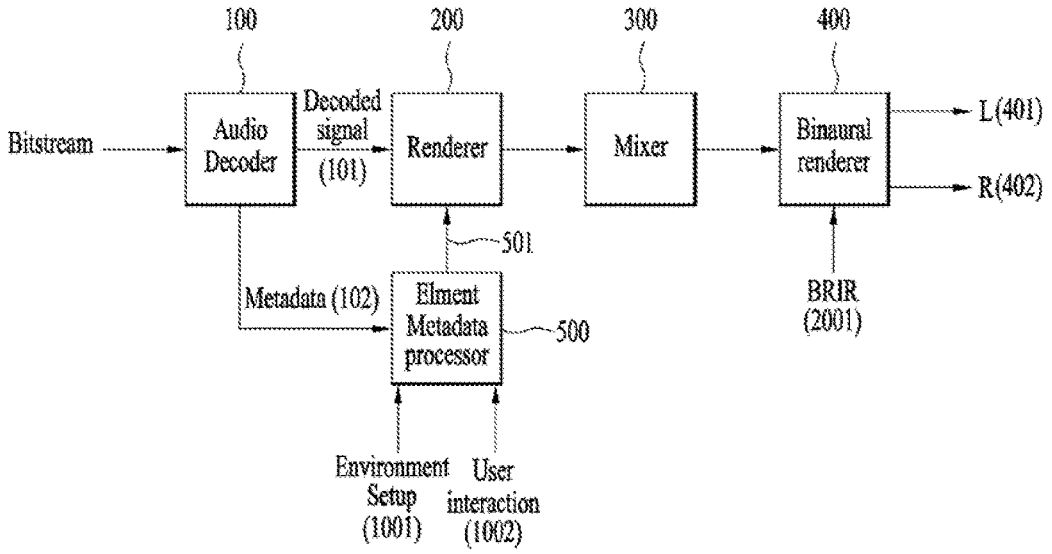
FIG. 1 is a diagram showing an example of configuration of an audio output apparatus according to the present invention.

Hereinafter, the present invention will be described in detail by explaining exemplary embodiments of the invention with reference to the attached drawings. The same reference numerals in the drawings denote like elements, and a repeated explanation thereof will not be given. In addition, the suffixes "module" and "unit" of elements herein are used for convenience of description and thus can be used interchangeably and do not have any distinguishable meanings or functions. In the description of the present invention, certain detailed explanations of related art are omitted when it is deemed that they may unnecessarily obscure the essence of the invention. The features of the present invention will be more clearly understood from the accompanying drawings and should not be limited by the accompanying drawings, and it is to be appreciated that all changes, equivalents, and substitutes that do not depart from the spirit and technical scope of the present invention are encompassed in the present invention.

FIG. 1 is a diagram showing an example of configuration of an audio output apparatus according to the present invention.

The audio output apparatus according to the present invention may include an audio decoder 100, a renderer 200, a mixer 300, and an element metadata processor (hereinafter simply "EMP" or "metadata processor") 500. The audio output apparatus according to the present invention may further include a binaural renderer 400 to provide 2-channel audio signals 401 and 402 with a surround effect in an environment that requires 2-channel audio output such as headphones or earphones. However, the binaural renderer 400 may have a configuration that is changed depending on a use environment and may be omitted.

A bitstream input to the audio decoder 100 may be transmitted from an encoder (not shown) in the form of a compressed audio file (.mp3, .aac, etc.). The audio decoder 100 may decode the input audio bitstream according to coded format and, then, output a decoded signal 101 and, also, may decode and output metadata 102. In this regard, the audio decoder 100 may be embodied as a unified speech and audio coding (USAC)-3D decoder. An embodiment of a USAC-3D decoder will be described below in more detail with reference to FIG. 6. However, the essential feature of the present invention is not limited to a specific format of the audio decoder 100. The decoded signal 101 may be input to the renderer 200. The renderer 200 may be embodied in various manners depending on use environment.

The metadata processor (EMP) 500 may receive the metadata 102 from the audio decoder 100. Simultaneously, the EMP 500 may receive user interaction information 1002 and environmental setup information 1001 from an external source. The environmental setup information 1001 may provide audio output that contains information indicating whether speakers or headphones are to be used and/or information on the number of playback speakers and information on a position of a playback speaker. The user interaction information 1002 may further provide "user position information" as the feature of the present invention as well as information on a change in object position and gain. The "user position information" may include "user position change indicator" and "user position change offset". An example of the "user position information" according to the present invention will be described below in detail with reference to FIGS. 5A and 5B.

When modification request information is present in the received user interaction information 1002, the EMP 500 may also apply the modification request information to modify content of the metadata 102 and may provide modified metadata 501 to the renderer 200.

The renderer 200 may receive the modified metadata 501 from the EMP 500 and render the decoded signal 101 according to the purpose of a use environment. The mixer 300 may synthesize audio signals output from the renderer 200 depending on a final reproduction environment and output the synthesized audio signals. In this regard, to gain a sufficient understanding of the present invention, the renderer 200 and the mixer 300 are shown as separate components but are not limited thereto. That is, the renderer 200 and the mixer 300 may be embodied as one component or function.

The audio output apparatus may further include the binaural renderer 400 in order to embody 3D surround audio output in a use environment of headphones or earphones. The binaural renderer 400 may filter an audio signal output through the renderer 200 and the mixer 300 using binaural room impulse response (BRIR) information 2001 to output left/right channel audio signals 401 and 402. In this regard, the BRIR information 2001 may be embodied and provided in the form of a database.

Figure 2:
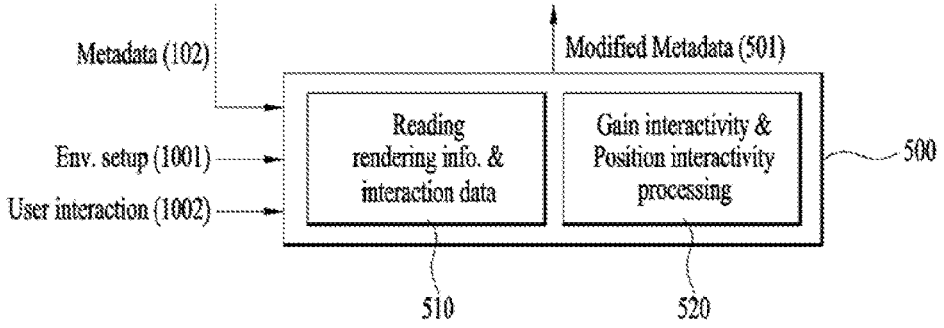
FIG. 2 is a diagram for explanation of an operation of the metadata processor (EMP) in the audio output apparatus according to the present invention.

FIG. 2 is a diagram for explanation of an operation of the metadata processor (EMP) 500 in the audio output apparatus of FIG. 1. That is, the EMP 500 may process the input metadata 102 via the following two procedures. A first procedure may include a reading procedure 510 of the input metadata 102, external input information, the environmental setup information 1001, and the user interaction information 1002. A second procedure may include a processing procedure 520 of processing object position and gain information based on the external input information 1001 and 1002. The modified metadata 501 may be provided to and used in the renderer 200 and/or the mixer 300 through the two operating procedures.

Figure 3:
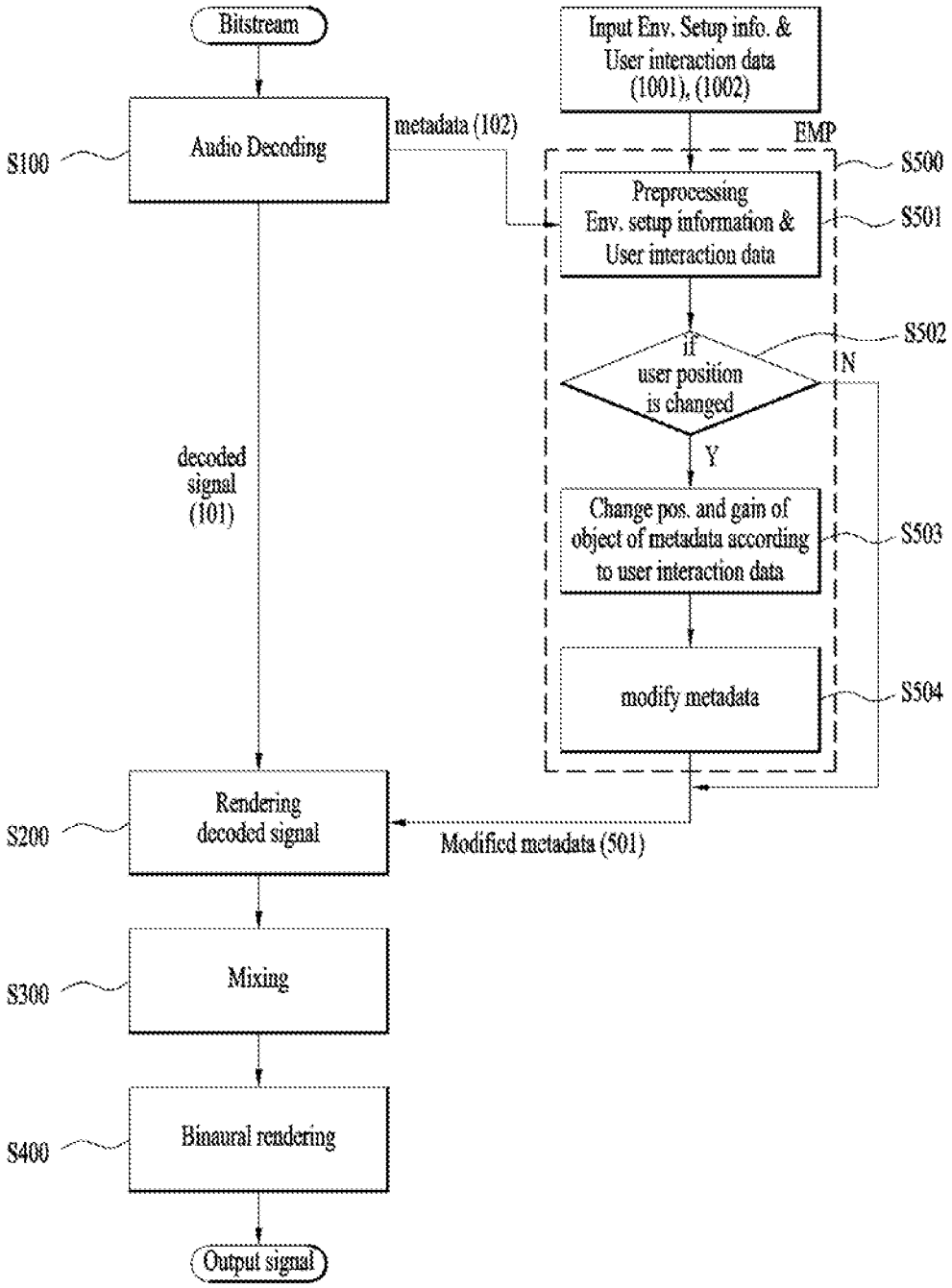
FIG. 3 is a flowchart showing an audio output method according to the present invention.

FIG. 3 is a flowchart showing an entire audio output method including the operation of the EMP 500 of FIG. 2, according to the present invention.

Operation S100 is a procedure in which the audio decoder 100 receives a bitstream including an audio signal and outputs the decoded signal 101 and decoded metadata 102.

Operation S500 is a procedure in which the EMP 500 receives the environmental setup information 1001 and the user interaction information 1002 as external information, corrects the metadata 102 based on the input external information 1001 and 1002 and, then, outputs the last modified metadata 501. Operations S200 and S300 are procedures in which the renderer 200 and the mixer 300 render and mix the decoded signal 101 using the modified metadata 501, respectively, to output a signal depending on the number of reproduction environmental channels set from the environmental setup information 1001.

Operation S400 is a procedure of binaural-rendering the audio signal output in the previous operation to output a 3D surround audio signal in a 2-channel reproduction environment.

In this regard, operation S500 through the EMP 500 will be described below in detail.

First, the metadata 102 and the external information 1001 and 1002 may be received and a preprocessing procedure may be performed (S501). For example, the preprocessing procedure may be performed as follows. Whether audio output is reproduced by a speaker or headphones may be determined based on the environmental setup information 1001. With reference to information on a position of a playback speaker and information on the number of speakers from the environmental setup information 1001, the information may be applied to the metadata 102. In this regard, the information on the position of the speaker may be provided as azimuth, elevation, and distance information. With reference to the object position information and the gain change information from the user interaction information 1002, the information may be applied to the metadata 102. In this regard, the object position information may be provided as azimuth, elevation, and distance information and the gain change information may be provided as a dB value.

After the preprocessing procedure (S501), whether a user position is changed in an arbitrary space may be checked (S502). For example, whether the user position is changed may be determined using "user position information" provided from the user interaction information 1002. As described above, the "user position information" may include "user position change indicator" and "user position change offset". Accordingly, whether the user position is changed may be determined through the "user position change indicator". An example of the "user position information" according to the present invention will be described in detail with reference to FIGS. 5A and 5B.

When the user position is changed (path "y"), the object position and gain information may be changed based on the user position change amount information (e.g., "user position change offset") of the "user position information" (S503). In particular, for example, the user position change amount may be represented as azimuth and/or distance information corresponding to an object, which will be described below in detail with reference to FIGS. 4A to 4C. Then, the metadata 102 may be modified using the changed object position and gain information (S504) and the last modified metadata 501 may be provided to a rendering operation (S200).

On the other hand, in operation S502, upon determining that a user position is not changed (path "n"), the metadata modified through the preprocessing operation (operation S501) may be provided to the rendering operation (S200).

FIGS. 4A to 4E are diagrams for explanation of object change along with change in user position, according to the present invention.

With reference to the user position change amount information (e.g., "user position change offset") of the "user position information" provided from the user interaction information 1002, the metadata may be modified. For example, in the present invention, the user position change amount information may be provided as change amounts of azimuth and distance based on an existing position. It may be possible to provide all of the change amounts of azimuth, elevation, and distance. Upon checking a changed user position, object position information may be changed base on the changed user position.

Figure 4A:
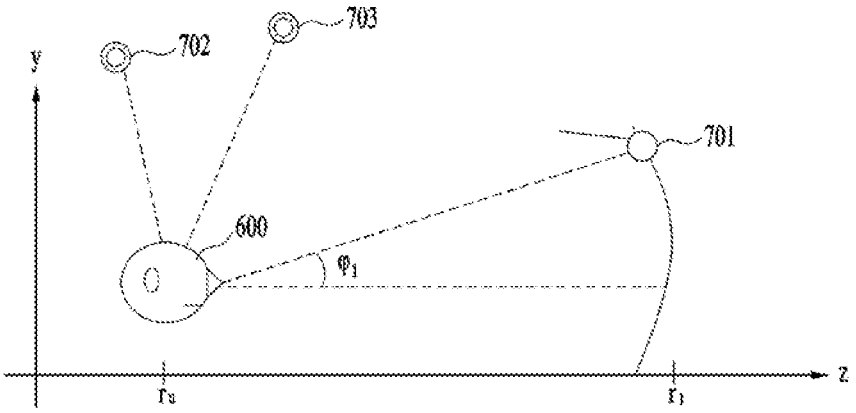
FIGS. 4A to 4E are diagrams for explanation of object change along with change in user position, according to the present invention.
Figure 4B:
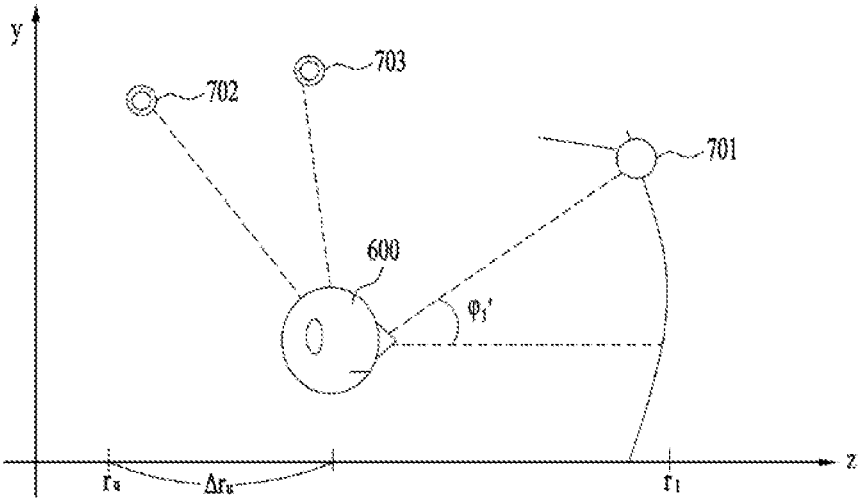
Figure 4C:
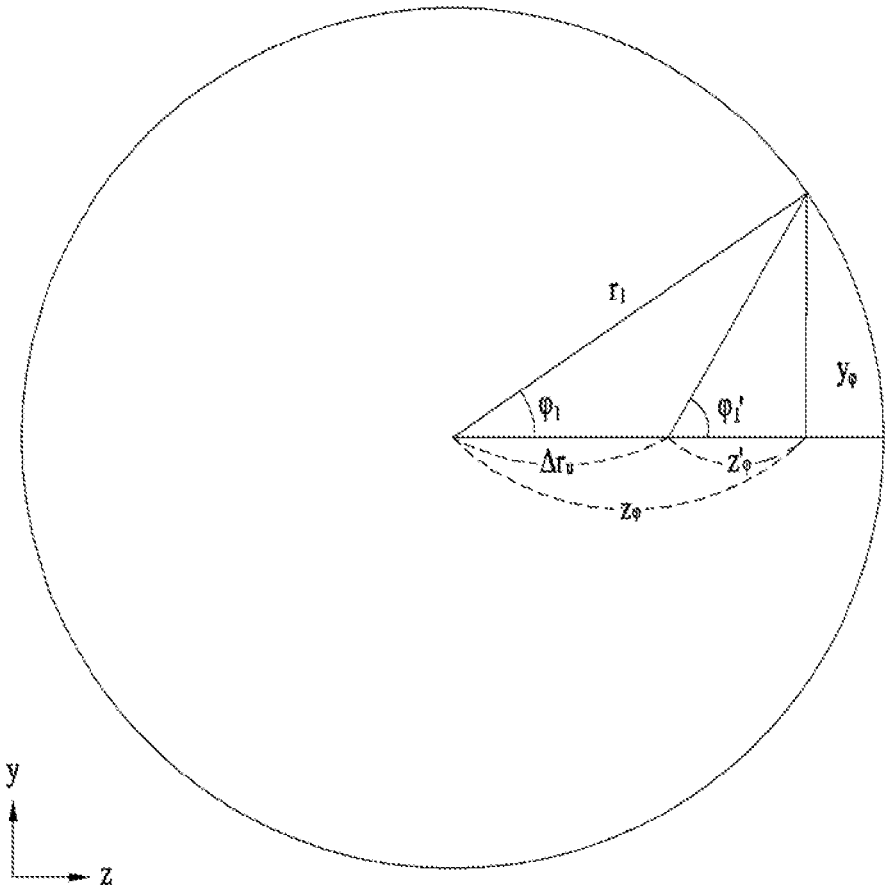
Figure 4D:
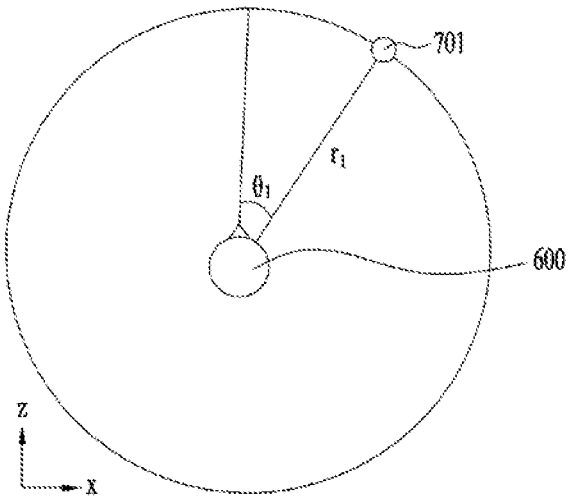

FIGS. 4A and 4D show a relative position between a user 600 and a first audio object-1 701 in an arbitrary space. FIG. 4A shows elevation $\varphi_1$ of the object-1 701 corresponding to a user position and FIG. 4D shows azimuth $\theta_1$ of the object-1 701 corresponding to the user position. Accordingly, with reference to FIGS. 4A and 4D, a position of the object-1 701 corresponding to a position $r_u$ of the user 600 may be represented by $POS_{obj1}=(\theta_1, \varphi_1, r_1)$.

Figure 4E:
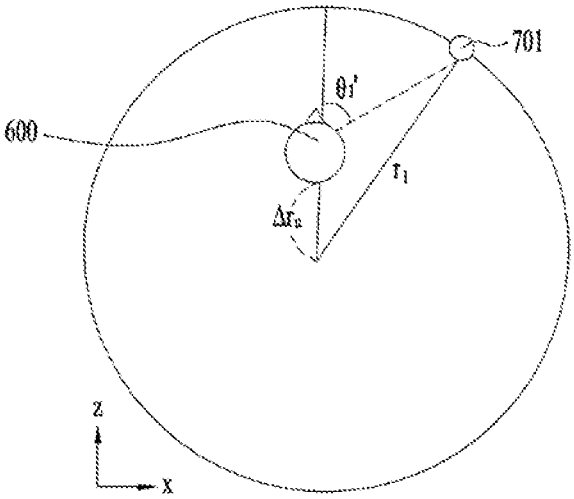

FIGS. 4B and 4E show the case in which a user position is changed in an arbitrary space. FIG. 4B shows an elevation change degree along with change in user position and FIG. 4E shows an azimuth change degree along with change in user position.

For example, based on the "user position information" according to a first embodiment of the present invention, a changed location of the user 600 may be represented as change amounts of azimuth and distance according to the following equation.

$$\Delta POS_{user}=(\Delta\theta_u,\Delta r_u).$$

Based on the user position change amount, relative azimuth $\Theta_1'$ and distance $r_1'$ corresponding to a user position of the object-1 701 may be determined as follows.

$$\Theta_1'=\theta_1-\theta_u, r_1'=r_1-r_u$$

As shown in FIG. 4C, change in relative elevation $\varphi_1'$ between a user and the object-1 701 may be calculated as follows due to change in user position.

$$y_\varphi = r_1\sin\varphi_1$$

$$z_\varphi = r_1\sqrt{1-\sin^2\varphi_1}$$

$$z_\varphi' = z_\varphi - \Delta r_u$$

$$\varphi_1' = \tan^{-1}\left(\frac{y_\varphi}{z_\varphi'}\right)$$

Accordingly, based on the azimuth and distance change amount and $\Delta POS_{user}=(\Delta\theta_u, \Delta r_u)$ as user position change information, it may be possible to obtain all elements (e.g., azimuth, elevation, and distance) constituting a changed position $POS_{obj1}=(\theta_1', \varphi_1', r_1')$ corresponding to a user position of the object-1 701.

For example, based on the "user position information" according to a second embodiment of the present invention, a changed position of the user 600 may contain azimuth, elevation, and distance change amount and may be represented as follows.

$$\Delta POS_{user}=(\Delta\theta_u,\Delta\varphi_u,\Delta r_u)$$

Accordingly, based on the user position change amount $\Delta POS_{user}=(\Delta\theta_u, \Delta\varphi_u, \Delta r_u)$, relative azimuth $\Theta_1'$, elevation $\varphi$1', and distance $r_1'$ corresponding to a user position of the object-1 701 may be determined as follows.

$$\Theta_1'=\theta_1-\theta_u, \varphi 1'=\varphi 1-\Delta\varphi_u, r_1'=r_1-r_u$$

That is, like the "user position information" according to the second embodiment of the present invention, when all of the azimuth, elevation, and distance variation amounts are provided as user position change amount information, the aforementioned separate calculation of the elevation change amount like in FIG. 4C may not be required.

In general, a plurality of audio objects may be present in an arbitrary space in a virtual reality (VR) environment or a game environment. It would be obvious to one of ordinary skill in the art that, when a plurality of audio objects, e.g., a second audio object-2 702 and a third audio object-3 703, are further present in an arbitrary space, a relative position $POS_{obj2}$ of the object-2 702 and a relative position $POS_{obj3}$ of the object-3 703 corresponding to a user position may be calculated using the same method as the aforementioned method in the object-1 701.

$$\Delta POS_{obj2}=(\theta_2',\varphi_2',r_2')$$

$$\Delta POS_{obj3}=(\theta_3',\varphi_3',r_3')$$

As a result, it may be possible to change positions of all objects present in an arbitrary space based on user position change $\Delta POS_{user}=(\Delta\theta_u, \Delta r_u)$.

When a user position is changed, a level (e.g., gain) of a recognized object may also be changed in response to relative distance change with the object. In general, since sound pressure is inversely proportional to the square of distance (inverse square law), a changed level value of a changed object in response to change in distance change may be calculated by the following equation (1).

$$OL_{obj_n} = \frac{r_{obj_n}^2}{(r_{obj_n}-r_u)^2} OL_{obj_n}, \text{ where } n = 1, 2, 3, \quad (1)$$

In equation (1), $OL_{obj_n}$ is a level value of an $n^{th}$ object.

According to another embodiment obtained by applying the present invention, it may be possible to provide user position change information based on elevation $\Delta\varphi_u$, but not azimuth $\Delta\theta_u$ and, in this case, it would be obvious to one of ordinary skill in the art that calculation of azimuth $\theta_u$ may be guided using the provided elevation $\Delta\varphi_u$ information. Accordingly, it would be obvious to one of ordinary skill in the art that all application embodiments are within the scope of the present invention.

FIGS. 5A and 5B show an example of audio syntax for providing user position information according to the present invention. FIG. 5A shows user interaction syntax applied to, for example, an MPEG-H 3D audio decoder and shows the case in which change amounts of azimuth and distance are provided as the user position information. FIG. 5B shows user interaction syntax applied to, for example, an MPEG-H 3D audio decoder and shows the case in which all change amounts of azimuth, elevation, and distance are provided as the user position information.

A box portion 800 indicated by a dotted line in FIG. 5A corresponds to the "user position information" according to the present invention provided in the user interaction syntax. First, isUserPosChange 801 may indicate whether a user position is changed. The isUserPosChange 801 may be information corresponding to the aforementioned "user position change indicator". That is, when a value of the isUserPosChange 801 is "0", this may indicate that a user position is not changed and, when the value is "1", this may indicate that a user position is changed.

up_azOffset 802 and up_distOffset 803 may be information indicating a user position change amount degree when a user position is changed (i.e., "isUserPosChange==1"). That is, the up_azOffset 802 and the up_distOffset 803 may correspond to the aforementioned "user position change offset" information.

The up_azOffset 802 may indicate a corresponding user position change degree as an offset value in terms of azimuth when a user position is changed. For example, the offset value may be given between AzOffset=−180 and AzOffset=180. Accordingly, user azimuth offset information uAzOffset may be set according to uAzOffset=1.5×(up_azOffset-128); uAzOffset=min (max(uAzOffset, −180), 180).

The up_distOffset 803 may indicate a user position change degree as an offset value in terms of a distance when a user position is changed. For example, the offset value may be given between DistOffset=0.5 m and DistOffset=16 m. Accordingly, for example, user distance offset information DistOffset may be set according to DistOffset=pow(2.0, (up_distOffset/3.0))/2.0; uDistOffset=min(max (uDistOffset, 0.5), 16).

In the syntax of FIG. 5A, reference numeral 900 is information provided in user interaction syntax. Through user interaction syntax of an MPEG-H 3D audio decoder, a user may change position or gain information in units of groups formed by binding a plurality of objects.

ei_groupID 901 may indicate an ID of a group as a change target.

ei_onOff 902 may indicate whether a corresponding group is used while being reproduced. That is, when the ei_onOff 902 is "0", this may indicate that the corresponding group is not used and, when the ei_onOff 902 is "1", this may indicate that the corresponding group is used. A user may reproduce only a specific group during a reproduction procedure. For example, assuming that group 1 is voice of an announcer and group 2 is background sound, the user may reproduce only group 2.

ei_routeToWIRE 903 may indicate whether an audio signal of a group is input as "WIRE". In addition, routeToWireID 904 may indicate an ID of "WIRE" for outputting a group.

ei_changePosition 905 may indicate whether a position of an element (object) of a group is changed. That is, when the ei_changePosition 905 is "0", this may indicate that the position is not changed and, when the ei_changePosition 905 is "1", this may indicate that the position is changed.

ei_azOffset 906 may indicate position change information as an offset value in terms of azimuth. For example, the azimuth offset value may be given between AzOffset=−180 and AzOffset=180. Accordingly, the value may be set according to AzOffset=1.5×(ei_azOffset−128); AzOffset=min(max(AzOffset,−180), 180).

ei_elOffset 907 may indicate position change information as an offset value in terms of elevation. For example, the elevation offset value may be given between ElOffset=−90 and ElOffset=90. Accordingly, the value may be set according to ElOffset=3×(ei_elOffset-32); ElOffset=min(max (ElOffset, −90), 90).

ei_distFact 908 may indicate position change information as a value of a multiplication factor in terms of distance. For example, the value may be given between 0.00025 and 8. Accordingly, the value may be set according to DistFactor= $2^{(ei_distFact-12)}$, DistFactor=min(max(DistFactor, 0.00025), 8).

ei_changeGain 909 may indicate whether level/gain of an element in a group is changed. That is, when the ei_changeGain 909 is "0", this may indicate that the level/gain is not changed and, when the ei_changeGain 909 is "1", this may indicate that the level/gain is changed.

ei_gain 910 may indicate additional gain of an element in a group. For example, a gain value may be given between 0 and 127. Accordingly, the value may be set according to Gain[dB]=ei_gain−64; Gain[dB]=min(max(Gain, −63), 31). When the ei_gain 910 is set to "0", Gain[dB] may be set as a value of −00.

FIG. 5B shows syntax formed by adding an elevation change amount, up_elOffset 804 as user position change amount information to the aforementioned syntax of FIG. 5A. That is, a box portion 800 indicated by a dotted line in FIG. 5B may correspond to the "user position information" according to the present invention provided in the user interaction syntax. In this regard, the isUserPosChange 801, the up_azOffset 802, and the up_distOffset 803 are the same as in the above description of FIG. 5A and, thus, a detailed description thereof will be omitted. The elevation change amount, up_elOffset 804 may indicate a corresponding position change degree as an offset value in terms of elevation when a user position is changed (i.e., "isUserPosChange==1"). The offset value may be given between ElOffset=−90 and ElOffset=90. Accordingly, for example, the value may be set according to uElOffset=3×(up_elOffset−32); uElOffset=min (max(uElOffset,−90), 90).

Figure 6:
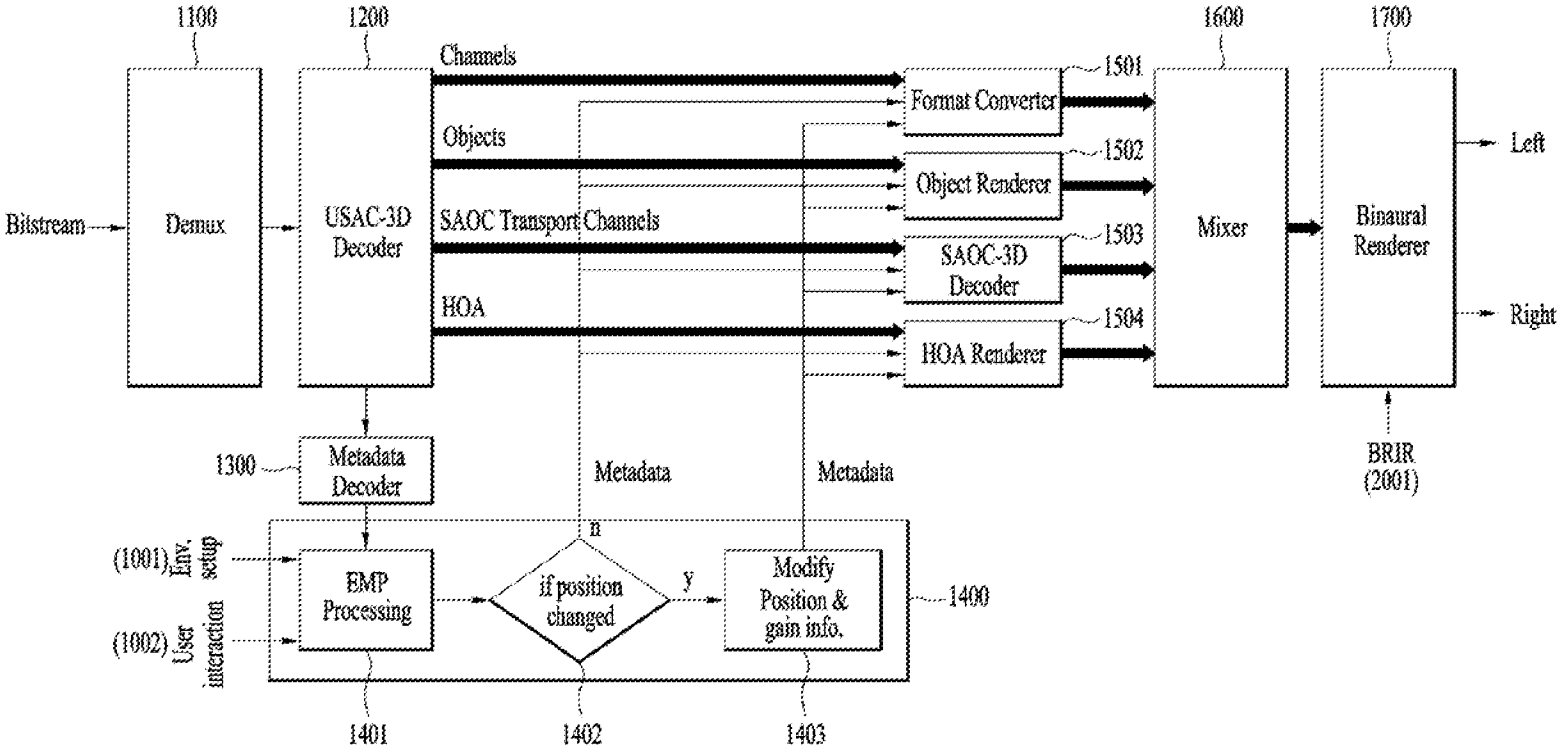
FIG. 6 is a diagram showing an audio output apparatus according to another embodiment of the present invention.

FIG. 6 shows an example of applying a unified speech and audio coding (USAC)-3D decoder 1200 to an audio output apparatus according to another embodiment of the present invention. A bitstream containing an audio signal input to the audio output apparatus may be demultiplexed by a demultiplexer (Demux) 1100 and, then, may be decoded by the USAC-3D decoder 1200 depending on the characteristics of an audio signal (e.g., channel, object, spatial audio object coding (SAOC), and higher order ambisonics (HOA)). The USAC-3D decoder 1200 may extract metadata. The extracted metadata may be input to a metadata processor (EMP) 1400 through a metadata decoder 1300. To gain a sufficient understanding of the present invention, the metadata decoder 1300 is separately shown but the metadata decoder 1300 may be configured in the aforementioned USAC-3D decoder 1200.

The environmental setup information 1001 and the user interaction information 1002 may also be input to an EMP processing unit 1401 from an external source and may be used to correct metadata information. The environmental setup information 1001 may provide information indicating whether a speaker or a headphone is used and information on the number of playback speakers and information on a position of a playback speaker. The user interaction information 1002 may further provide the aforementioned "user position information" as information related to user position change in addition to object position information and gain change information. When a user position is changed (path "y" of 1402), the object position information and the gain information may be corrected according to the changed user position, as described above (1403). Then, the corrected metadata may be provided to transformers 1501 to 1504 appropriate for an audio signal type according to characteristics thereof. The transformer may be, for example, a format converter 1501 when the audio characteristic corresponds to a channel signal, an object renderer 1502 in the case of an object signal, an SAOC 3D-decoder 1503 in the case of SAOC transport channels, and an HOA renderer 1504 in the case of an HOA signal. Then, an output signal may be generated through a mixer 1600. When the audio output apparatus is applied to a VR environment, 3D sound field feeling needs to also be transmitted through 2-channel speakers such as headphones or earphones and, thus, an output signal may be filtered using the BRIR information 2001 by a binaural renderer 1700 and, then, a left/right audio signal with a 3D surround effect may be output. When a user position is not changed (path "n" of 1402), only the metadata information corrected by the EMP processing unit 1401 may be provided to the transformers 1501, 1502, 1503, and 1504.

An audio output method and apparatus according to the embodiments of the present invention may have the following advantages.

First, an audio sound image that is simultaneously changed in response to user position change in an arbitrary space may be provided, thereby providing more realistic audio output.

Second, efficiency of implanting MPEG-H 3D audio as a next-generation immersive 3D audio coding technique may be enhanced. That is, as a syntax compatible with the standard obtained by developing the existing MPEG-H 3D audio may be further provided, coding technology for allowing a user to feel audio with unchanged sense of immersion regardless of a user position in an arbitrary space may be provided.

Third, in various audio application fields such as a game or VR space, a natural and realistic effect according to a changed user position may be provided.

The aforementioned present invention can also be embodied as computer readable code stored on a computer readable recording medium. The computer readable recording medium is any data storage device that can store data which can thereafter be read by a computer. Examples of the computer readable recording medium include a hard disk drive (HDD), a solid state drive (SSD), a silicon disc drive (SDD), read-only memory (ROM), random-access memory (RAM), CD-ROM, magnetic tapes, floppy disks, optical data storage devices, carrier wave (e.g., transmission via the Internet), etc. In addition, the computer may include an audio decoder, a metadata processor (EMP), a renderer, and a transformer as whole or some components. It will be apparent to those skilled in the art that various modifications and variations can be made in the present invention without departing from the spirit or scope of the inventions. Thus, it is intended that the present invention cover the modifications and variations of this invention provided they come within the scope of the appended claims and their equivalents.

What is claimed is:

1. A method for decoding a bitstream for an audio signal by an audio decoder, the method comprising:

obtaining, by the audio decoder, a user position change indicator from the bitstream, the user position change indicator indicating whether a user position is changed;

obtaining, by the audio decoder, a user position change offset from the bitstream based on the user position change indicator indicating that the user position is changed, the user position change offset indicating a change amount of the user position when the user position is changed;

obtaining, by the audio decoder, an object position change indicator from the bitstream, the object position change indicator indicating whether an object position is changed;

obtaining, by the audio decoder, an object position change offset from the bitstream based on the object position change indicator indicating that the object position is changed, the object position change offset indicating a change amount of the object position when the object position is changed;

obtaining, by the audio decoder, modified metadata based on the user position change offset and the object position change offset; and rendering, by the audio decoder, the audio signal using the modified metadata, wherein the user position change offset is skipped in the bitstream based on the user position change indicator indicating that the user position is not changed, and the object position change offset is skipped in the bitstream based on the object position change indicator indicating that the object position is not changed.

2. The method according to claim 1, wherein the user position change offset comprises at least an azimuth offset and a distance offset.

3. The method according to claim 1, wherein the user position change offset comprises at least an azimuth offset, an elevation offset, and a distance offset.

4. The method according to claim 1, wherein the user position change offset comprises any one of an azimuth offset and an elevation offset.

5. The method according to claim 1, wherein the modified metadata comprises a changed relative position or gain of an audio object in an arbitrary space, corresponding to a change in the user position and a change in the object position.

6. The method according to claim 1, further comprising performing, by the audio decoder, binaural rendering using a binaural room impulse response (BRIR) for 2-channel surround audio output of the rendered audio signal.

7. An apparatus for decoding a bitstream for an audio signal, the apparatus comprising:

a metadata processor configured to obtain a user position change indicator from the bitstream, the user position change indicator indicating whether a user position is changed, to obtain a user position change offset from the bitstream based on the user position change indicator indicating that the user position is changed, the user position change offset indicating a change amount of the user position when the user position is changed, to obtain an object position change indicator from the bitstream, the object position change indicator indicating whether an object position is changed, to obtain an object position change offset from the bitstream based on the object position change indicator indicating that the object position is changed, the object position change offset indicating a change amount of the object position when the object position is changed, and to obtain modified metadata based on the user position change offset and the object position change offset; and a renderer configured to render the audio signal using the modified metadata, wherein the user position change offset is skipped in the bitstream based on the user position change indicator indicating that the user position is not changed, and the object position change offset is skipped in the bitstream based on the object position change indicator indicating that the object position is not changed.

8. The apparatus according to claim 7, wherein the user position change offset comprises at least an azimuth offset and a distance offset.

9. The apparatus according to claim 7, wherein the user position change offset comprises at least an azimuth offset, an elevation offset, and a distance offset.

10. The apparatus according to claim 7, wherein the user position change offset comprises any one of an azimuth offset and an elevation offset.

11. The apparatus according to claim 7, wherein the modified metadata comprises a changed relative position or gain of an audio object in an arbitrary space, corresponding to a change in the user position and a change in the object position.

12. The apparatus according to claim 7, further comprising a binaural renderer configured to perform binaural rendering using a binaural room impulse response (BRIR) for 2-channel surround audio output of the rendered audio signal.

13. An apparatus for decoding a bitstream for an audio signal, the apparatus comprising:

a unified speech and audio coding (USAC)-3D audio decoder configured to receive the bitstream audio signal and to provide metadata appropriate for characteristics of the audio signal;

a metadata processor configured to obtain a user position change indicator from the bitstream, the user position change indicator indicating whether a user position is changed, to obtain a user position change offset from the bitstream based on the user position change indicator indicating that the user position is changed, the user position change offset indicating a change amount of the user position when the user position is changed, to obtain an object position change indicator from the bitstream, the object position change indicator indicating whether an object position is changed, to obtain an object position change offset from the bitstream based on the object position change indicator indicating that the object position is changed, the object position change offset indicating a change amount of the object position when the object position is changed, and to obtain modified metadata based on the provided metadata and the user position change offset and the object position change offset; and a transformer configured to render the audio signal using the modified metadata according to the characteristics of the audio signal, wherein the user position change offset is skipped in the bitstream based on the user position change indicator indicating that the user position is not changed, and the object position change offset is skipped in the bitstream based on the object position change indicator indicating that the object position is not changed.

14. The apparatus according to claim 13, wherein the transformer operates as a format converter when the characteristics of the audio signal corresponds to a channel signal, operates as an object renderer for an object signal, operates as a spatial audio object coding (SAOC) 3D-decoder for a SAOC transport channel, and operates as a higher order ambisonics (HOA) renderer for a HOA signal.

15. The apparatus according to claim 13, wherein the user position change offset comprises any one of an azimuth offset and an elevation offset.

16. The apparatus according to claim 13, wherein the modified metadata comprises a changed relative position or gain of an audio object in an arbitrary space, corresponding to a change in the user position and a change in the object position.

17. The apparatus according to claim 13, further comprising a binaural renderer configured to perform binaural rendering using a binaural room impulse response (BRIR) for 2-channel surround audio output of the audio signal transformed by the transformer.

* * * * *